United States Patent [19]

Bandelj

[11] 4,393,374

[45] Jul. 12, 1983

[54] LOW POWER SIREN

[75] Inventor: Bojan Bandelj, Skofja Loka, Yugoslavia

[73] Assignee: ISKRA-SOZD elektrokovinske industrije n.sol.o., Ljubljana, Yugoslavia

[21] Appl. No.: 246,842

[22] Filed: Mar. 23, 1981

[30] Foreign Application Priority Data

Mar. 24, 1980 [YU] Yugoslavia ..... 816/80

[51] Int. Cl.[3] ..... G08B 3/00; G10K 7/04

[52] U.S. Cl. ..... 340/405; 340/384 R

[58] Field of Search ..... 340/405, 404, 384 R

[56] References Cited

U.S. PATENT DOCUMENTS 2,314,260 3/1943 Williamson ..... 340/405

3,069,675 12/1962 Parissi ..... 340/405

4,138,673 2/1979 Faust ..... 340/405

FOREIGN PATENT DOCUMENTS 2371034 7/1978 France ..... 340/405

*Primary Examiner*—John W. Caldwell, Sr.

*Assistant Examiner*—Daniel Myer

*Attorney, Agent, or Firm*—Fleit, Jacobson & Cohn

[57] ABSTRACT

A low power siren having a high power sound and good tonal pattern. The siren consists of a casing with a motor and shaft protruding into a second casing. The inlet into the second casing allows for the passage of air, passing a rotor. Air cutters around the rotor merge with ribs which connect with a hub which is connected to the shaft. Air drawn through the inlet by rotation of the rotor passes the air cutters producing a noise.

5 Claims, 10 Drawing Figures

LOW POWER SIREN

Object of the invention is to provide a cast low-power siren driven by an electromotor.

Known embodiments of low-power sirens are made in such manner that they are assembled of three main parts, i.e., the sound forming nozzle, the middle part with the sound producing openings, and the casing in which is positioned the motor for rotating the rotor. The rotor which can have different shapes rotates inside the middle part of the siren in the level of sound producing openings, it cutting the air flowing through said openings because of rotation of rotor.

Disadvantages of known low-power sirens lie in a low sound-power and a poor tonal pattern, the sound containing only a low number of harmonic frequencies.

The aim of the invention is to provide a construction of a low-power siren having a comparatively high sound-power and a good tonal pattern.

The solution of the aim as stated is described on the basis of the drawings, in which.

Figure 1:
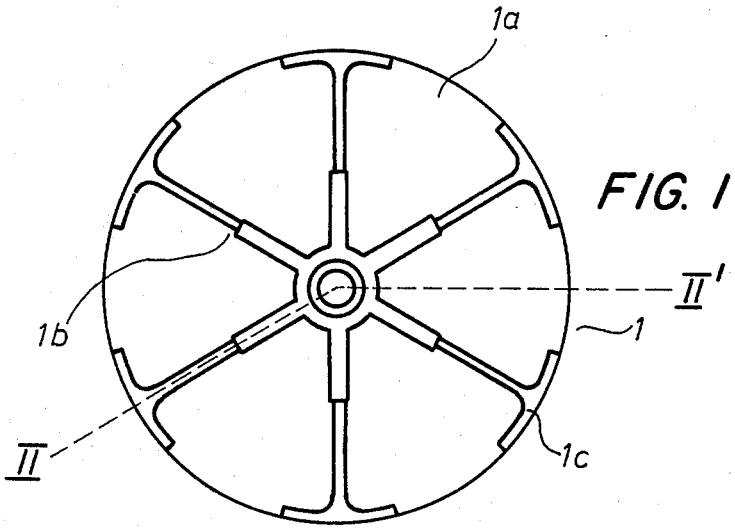
FIG. 1 is a front plan view of the rotor used in one embodiment of a low-power siren according to the present invention.
Figure 2:
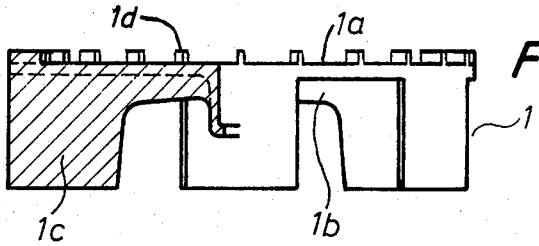
FIG. 2 is a side view of the rotor of FIG. 1, with a partial section along line II—II' of FIG. 1.
Figure 3:
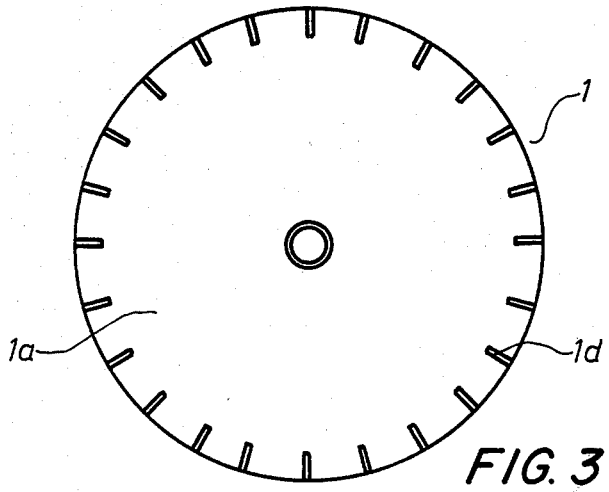
FIG. 3 is a rear plan view of the rotor of FIG. 1.
Figure 4A:
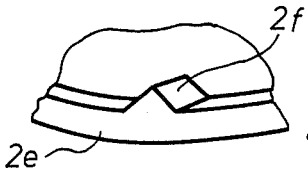
FIG. 4 is a side view of the front part of one embodiment of the siren of the present invention, with a partial section along line IV—IV of FIG. 5.
Figure 4:
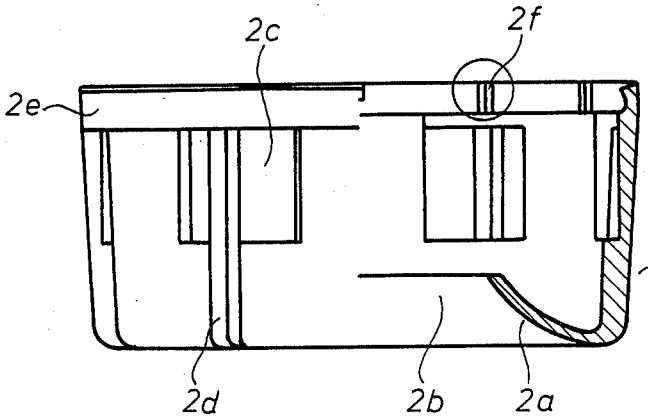
Figure 5:
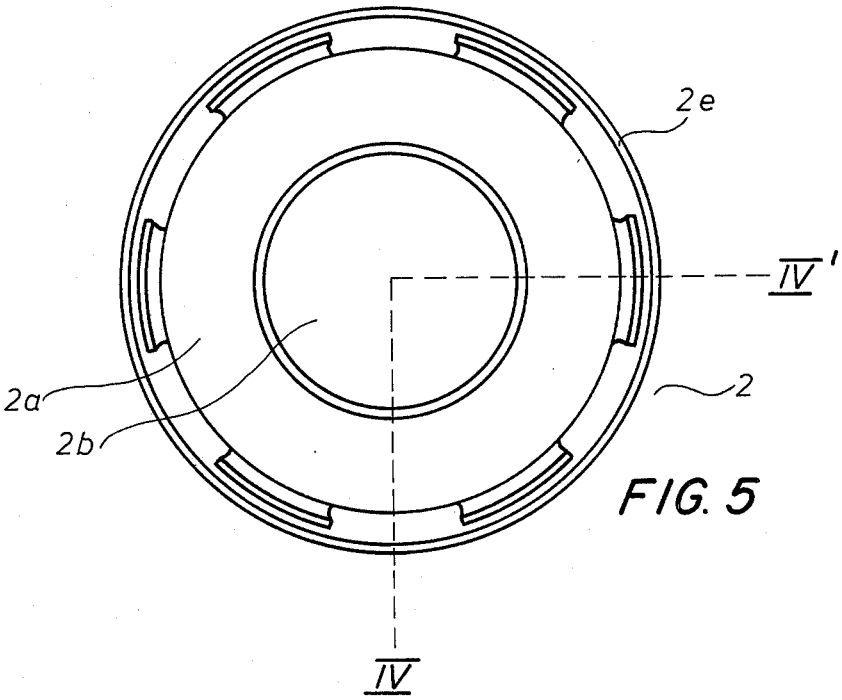
Figure 6:
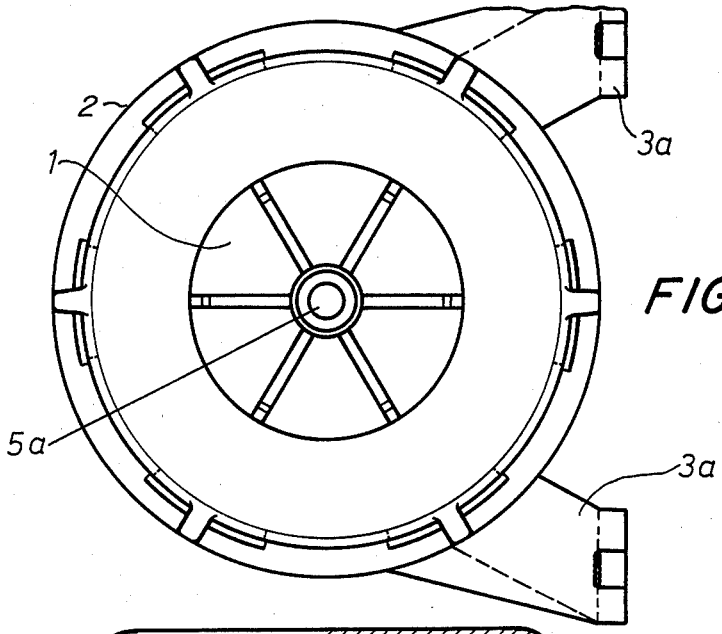
Figure 7:
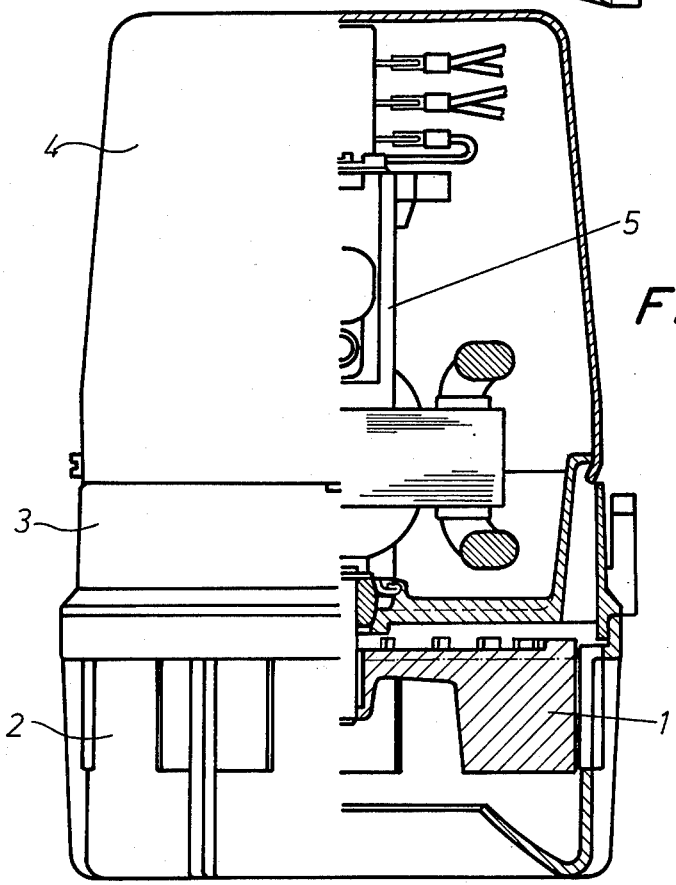
Figure 8:
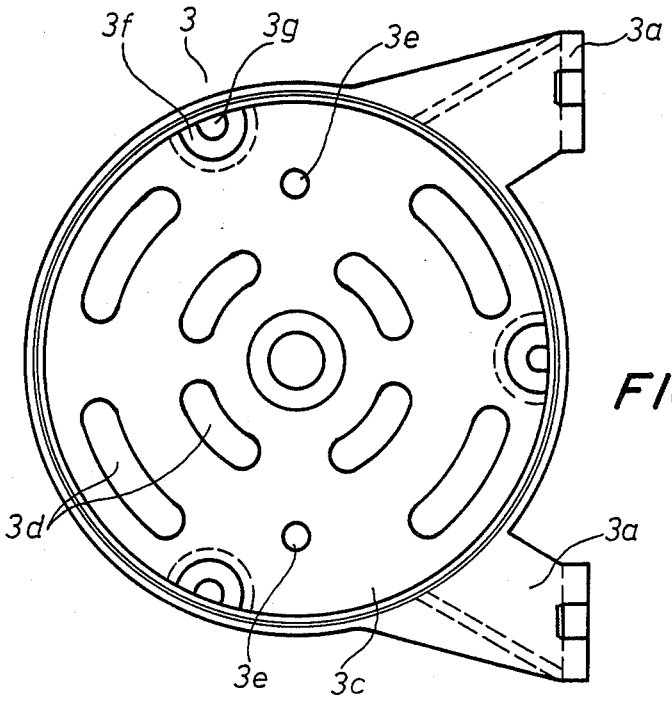

FIG. 4*a* is a detail, on an enlarged scale, of the front part of FIG. 4;

FIG. 5 is a rear plan view of the front part of FIG. 4;

FIG. 6 is a front plan view of one embodiment of the assembled siren of the present invention;

FIG. 7 is a side view of the assembled siren of FIG. 6, partially in section;

FIG. 8 is a rear view of the middle part of the siren of FIG. 6; and

Figure 9:
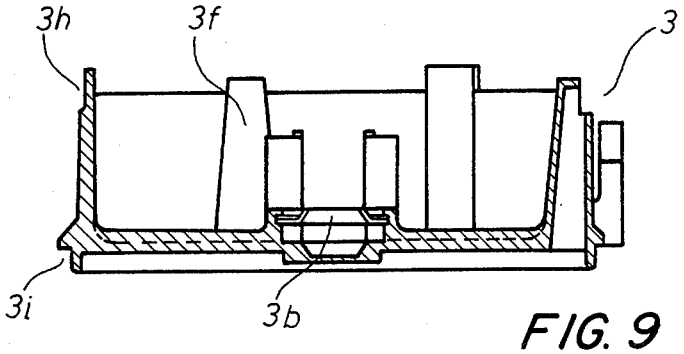

FIG. 9 is a side sectional view of the middle part of FIG. 8.

The rotor 1 is made of a circular disc 1*a* which on its front side is provided with low ribs 1*b* cast simultaneously and positioned to extend perpendicular to the disc, passing into air cutters 1*c*. The rear side of the disc 1*a* is provided with simultaneously cast low ribs 1*d*.

The central hub or ribs 1*b* pass radially from the middle of the rotor 1 towards the circumference and serve as a reinforcement of air cutters 1*c*.

The ribs 1*d* at the rear side of the rotor 1 serve for the ventilation of the driving electromotor 5 and the frequency enrichment (tonal pattern) of the siren.

The front part 2 of the siren has a cylindrical form, the part for producing the sound and the nozzle forming a unity. The nozzle 2*a* is formed by inwardly bent facing part of the front part 2, it having a central round opening 2*b*. On the circumference of the part 2, rectangular openings 2*c* are made for the production of sound, they being in their middle divided by ribs 2*d* for a reinforcement thereof. The rear part of the front part 2 is a ring 2*e*, the diameter of which is larger than the remaining part of the front part 2 so that openings 2*c* essentially continue below it. On the inner side of the ring 2*e* there are on the whole circumference positioned triangular teeth 2*f* for fixing the part 2 onto the part 3. The front part 2 slightly converges towards the nozzle 2*a*.

The middle part 3 also having a cylindrical form connects the front part 2 and the casing 4. Thereon two legs 3*a* for mounting the siren are made. In the middle there is positioned the part 3*b* for bearing the shaft 5*a* of the electromotor 5. On the rear plate 3*c* separating the sound part of the siren from the driving part there are arranged oval curved openings 3*d* for the circulation of air for cooling the electromotor 5, two openings 3*e* for fastening the electromotor 5 and three half-cylinders 3*f* for fastening the casing 4.

The casing 4 encloses the electromotor 5, thereby enabling protection and compactness of the siren. Under the casing 4 there is beside the electromotor 5 still room for a subsequent installation of a relay.

The siren is assembled in such manner that the shaft 5*a* is inserted into the bearing part 3*b*, the housing of the electromotor 5 being fixed with screws through the openings 3*e* of the plate 3*c* of the middle part 3.

The casing 4 can be fixed onto the middle part 3 in two different ways. In the first instance the casing 4 is put on the edge 3*h* of the middle part 3, whereafter it is slightly bent into three half-cylindrical openings 3*g* on half-cylinders 3*f*. In the second instance the casing 4 can be fastened onto the middle part 3 in known manner with screws.

Onto the shaft 5*a* of the electromotor 5 the rotor 1 is fixed and, subsequently, onto the edge 3*i* the front part 2 is fixed whereby the teeth 2*f* thereof are firmly pressed into the middle part 3.

The rotor 1 with its cutters 1*c* being inclined to the same extent as the front part 2 rotates in the interior of the front part 2 in such manner that the slot on the circumference between the air cutters 1*c* and the openings 2*c* for the production of sound remains constant, which was not the case with known embodiments because of a different embodiment of the openings for the production of sound.

Likewise, the slot on the longitudinal axis between the air cutters 1*c* and the openings 2*c* has a constant wideness because the air cutters 1*c* on the longitudinal axis are parallel with the openings 2*c*.

The openings 2*c* are also prolongated under the ring 2*e* and therefore the air can additionally be cut by the cooling ribs 1*d* on the rear side of the disc 1*a* of the rotor 1 whereby the tonal pattern is enriched.

The constant slot on the circumference and the uniform slot on the longitudinal axis between the air cutters 1*c* and the openings 2*c* as well as the additional influence of the cooling ribs 1*d* on the rotor 1 cause a substantial improvement of the sound volume and a substantial improvement of the sound quality (sound pattern) of the siren, which was the aim of the invention.

What is claimed is:

1. A low power siren comprising:

a first casing;

a motor disposed in said first casing and having an output shaft protruding from said first casing;

a second casing having an inlet end defining a nozzle for admitting air into the interior thereof, said walls, and openings formed in the side walls for egress of air from the interior of said second casing;

means for interconnecting said first and said second casings; and a rotor disposed in said second casing, said rotor having a hub connected to said shaft, a plurality of air cutters having circumferentially extending portions extending around the periphery of said rotor, and ribs merging with said air cutters for directly connecting central portions of the circumferentially extending portions of the air cutters with said hub whereby air drawn into said second casing through said nozzle by rotation of said rotor passes said air cutters generating noise and exits said second casing through said side wall openings, said air cutters and said ribs being positioned on one surface of said rotor and a plurality of low ribs extending outwardly from an opposed surface of said rotor, said low ribs being equally circumferentially spaced around the periphery of said rotor and contributing to the noise generated by rotation of said rotor.

2. A low power siren according to claim 1, wherein said side wall openings are rectangular shaped and positioned so that the one and the opposed surfaces of said rotor are located in planes passing through said openings.

3. A low power siren according to claim 1, wherein said means for interconnecting comprises a middle casing having one end portion releasably engaged with said first casing and an opposed end portion releasably engaged with said second casing, said middle casing having a plate disposed between said first and said second casings, said plate having a plurality of curved openings formed therein for admitting cooling air into said first casing.

4. A low power siren according to claim 3, wherein said rotor is positioned in said second casing such that there is a uniform gap between said air cutters and side walls of said second casing and a uniform gap between said low ribs and said plate.

5. A low power siren according to claim 3, wherein a plurality of teeth are provided on an end surface of said second casing for interconnecting said second casing with said middle casing.

* * * * *